US005423917A

United States Patent [19]

Garcia, Jr.

[11] Patent Number: 5,423,917

[45] Date of Patent: Jun. 13, 1995

[54] METHOD FOR CLEANING HEAT EXCHANGER TUBES BY CREATING SHOCK WAVE AND MIXING THE LIQUID WITH INJECTED AIR

[76] Inventor: Ralph Garcia, Jr., 19711 Oakland Valley Dr., Katy, Tex. 77449

[21] Appl. No.: 16,855

[22] Filed: Feb. 12, 1993

[51] Int. Cl.[6] ..... B08B 3/12; B08B 9/02

[52] U.S. Cl. ..... 134/1; 134/22.11; 134/22.12; 134/167 C; 134/169 C

[58] Field of Search ..... 134/1, 22.11, 22.12, 134/167 C, 169 C, 166 C

[56] References Cited

U.S. PATENT DOCUMENTS

| | | | |
|---|---|---|---|
| 3,565,689 | 2/1971 | Lowe et al. | 134/22.12 |
| 4,655,846 | 4/1987 | Scharton et al. | 134/1 |
| 4,716,611 | 1/1988 | Barry | 134/1 |
| 4,724,007 | 2/1988 | Barry et al. | 134/1 |
| 4,756,770 | 7/1988 | Weems et al. | 134/22.12 |
| 4,878,517 | 11/1989 | Prange | 134/167 C X |
| 5,183,513 | 2/1993 | Sajewski | 134/22.12 |

*Primary Examiner*—Scott Kastler
*Assistant Examiner*—Saeed Chaudhry
*Attorney, Agent, or Firm*—Gunn & Associates

[57] ABSTRACT

A method for cleaning tubes and heat exchangers as set forth. The method and apparatus involve an elongate lance which is mounted to move in an X and Y pattern to align with a set of tubes. Each tube is cleaned by positioning the lance at the end of each tube to be cleaned. A plug is placed in the tube to be cleaned to form a standing column for water. By means of a valve control system, the standing column of water is cycled from low to high pressure by switching the flow of water. In this switched mode, water is delivered under pressure into the column. The lance tip functions in conjunction with an orifice upstream of the lance tip to form a shock wave of energy radiating along the standing column of water from the orifice into the tube to be cleaned. The addition of water to the tube ultimately moves the plug along the length of the tube. It is one theory of operation of the present disclosure that the column of water exposed to shock waves is used in cleaning, i.e., shock waves do the cleaning while the addition of water merely provides sufficient water to form the standing column of water in the tube.

14 Claims, 2 Drawing Sheets

PRESSURE AIR
PRESSURE AIR
PRESSURE AIR
WATER
V REG.
V REG.
P
M
V
X
10
11
12
13
14
15
16
17
18
20
21
22
23
24
25
26
27
28
29
30
32
36
37
38
39
40
41
42
43
45
46
48
50
51
66

METHOD FOR CLEANING HEAT EXCHANGER TUBES BY CREATING SHOCK WAVE AND MIXING THE LIQUID WITH INJECTED AIR

BACKGROUND OF THE DISCLOSURE

A heat exchanger is a device which is normally formed of a plurality of parallel tubes. Typically, a fluid to be heated (or perhaps cooled) is delivered through a heat exchanger. The tubes are contacted on the exterior of the tubes with a fluid which adds heat or removes heat as required. The nest of tubes forms a bundle. There will be typically a set of end plates known as heads constructed and arranged at the opposite ends of the tubes to support the plurality of tubes. Typically, heat exchangers are installed and operated in continuous fashion. Continuous use is normally carried on for several months. However, it is necessary to interrupt the process and to clean the tubes. The tubes typically collect a residue on the inner surface which reduces the heat transfer capabilities of the tubes. The tubes are normally formed of metal which has a relatively high thermal conductivity. The material which may coat on the interior, however, will not have an equal thermal efficiency for transfer of heat flux. Therefore, the coating formed on the interior of the tubes is detrimental to continued operation. Worse than that, as it builds up, the tube becomes more inefficient. One way to counter act this is to raise the temperature differential. However, there are limits to this. For instance, the metal used in the tubes of the heat exchanger has a limited capacity for heat as a result of metallurgical considerations. For instance, a heat exchanger which might operate for twenty years when operated at one temperature might have a life of only two years when operated at a temperature 100° higher. The fatigue phenomena involved in constant exposure to elevated temperature is regrettably increased with an increase in temperature.

A typical heat exchanger is formed with a set of 180° bends or elbows at the ends of the respective tubes to enable the fluid to be heated to flow in a repetitive fashion through the heat exchanger. At the time of cleaning, the bends are removed. This exposes the parallel or lengthwise tubes for cleaning. Cleaning normally involves reinoval of the accumulated trash or coating material on the inside of the tubes. The tubes can be fairly long. If they were sufficiently short and the tubes were of relatively large diameter, this would ordinarily enable hand cleaning or at least cleaning with a straight rod or similar cleaning instrument. As exchanger designs have become better, there has been a tendency to increase the length of the tube as a result of increasing the width of the heat exchanger. The cleaning task is somewhat difficult because the long and relatively narrow tubes do not permit access. They can be cleaned by pumping water or perhaps chemically active solvents into the tubes. That is successful but it has limitations. Moreover, since a typical heat exchanger includes a very large number of tubes, it is necessary to undertake the cleaning in a repetitive fashion so that a large number of tubes can be cleaned.

The present apparatus is summarized as a structure which incorporates a continuously operated pump with a sump. The pump delivers the output through a valve which is switched to deliver water under pressure through a controllable orifice. That delivers the water under pressure to a control cabinet which includes a plurality of valves. The valves determine the delivery of the water under pressure. It is delivered through an output line to a ram. The ram cooperates with a lance which is aligned with individual tubes. The lance is directed in an X and Y pattern by a control mechanism to align with selected tubes. The lance is able to travel forwardly in the Z direction. It is constructed on a piston and cylinder mechanism which enables hydraulic control of lance insertion and retraction. When insertion occurs, the tip of the lance is placed in the particular tube to be cleaned. Hydraulic control enables rapid indexing of the lance to the left and right to align with the proper tube and to insert into that tube once alignment has been accomplished. The tip of the lance is profiled so that it forms a fairly quick but not perfect seal with the end of the tube. It is hollow to deliver liquid through the end of the lance into the tube. An optional air inlet is also provided through the lanced tip. A pressure surge is set up by timed operation of the pump in cooperation with the orifice. Moreover, this delivers a flow of water into the tube. By appropriate shock wave creation with a mix of air and water injected violently into the tube, the corrosion materials collecting on the inside of the tube are fractured and break away. There is a rapid flow of multiphase fluid through the tube. This rapid flow agitates the corrosive material with sufficient shock tremors that it is broken and will flake off the wall and thereby be flushed out the tube.

BRIEF DESCRIPTION OF THE DRAWINGS

So that the manner in which the above recited features, advantages and objects o the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIFHON OF THE PREFERRED EMBODIMENT

Figure 1:
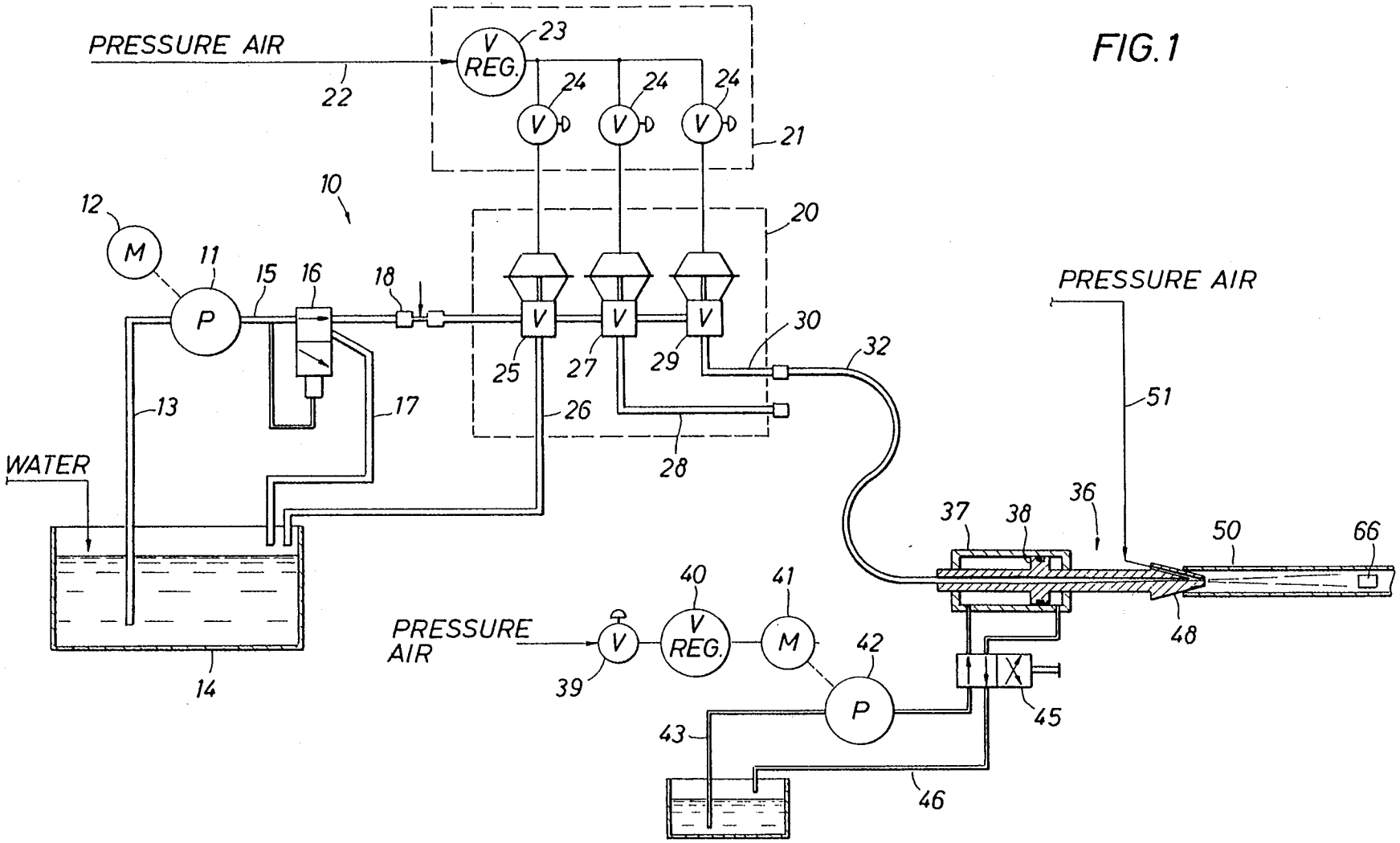
FIG. 1 is a schematic flow diagram of the system forming a shock wave as set forth in the present disclosure and shows in a combined schematic the fluid flow of air and water in the system.

Attention is now directed to FIG. 1 of the drawings which illustrates the schematic of the system. It will be described first. The description will be extended to the second sheet of drawings for a description of the lance mounting mechanism. Last of all, a system description of the device in operation will be given. Therefore, FIG. 1 of the drawing shows a system generally indicated by the numeral 10 which is used for cleaning of the tubing to be described. It incorporates a pump 11 which is driven by a suitable motor 12 of substantial power. It is provided with a feed line 13 from a water sump 14. As required, water is periodically added to the sump. Moreover, the water is typically pure but it can be used with additives. For instance, certain types of acids or bases can be added to accomplish chemical attack on the material to be removed.

The pump 11 has a pump output 15 which is provided to a control valve 16. The valve 16 is a two position valve. In the illustrated position, water under pressure is delivered from the pump through an adjustable orifice 18. The valve 16 also connects with a line 17 which provides a return to the sump. The orifice 18 provides an input to a control cabinet 20 represented in dotted line for operator control.

The control cabinet operates in conjunction with an air pressure manifold 21. There is a supply of pressurized air on a line 22 which is input to a regulator valve 23. That provides a regulated air pressure output through several control valves at 24. They are all duplicate and connect in parallel to the output side of the regulator 23.

The several regulators shown in the manifold are input to water control valves in the cabinet 20. The first valve 25 is connected with a line 26 which provides another return to the sump. The valve 25, when operated, delivers the output flow through a control valve 27. It connects with a flow line 28 for purposes to be described. In addition, flow is delivered to a valve 29 which provides an output flow that is switched when the valve 29 is operated. This output is on a line 30. The cabinet 20 has appropriate fittings on it to enable connection of a lance feed line 32. The line 32 extends some distance, typically from 10 to 50 feet. Preferably the length of the line is kept relatively short so that pressure surges are not damped in the flow line.

The numeral 36 identifies the lance of the present apparatus. It is mounted for hydraulic movement. More particularly, the lance 36 is coaxial with an elongate cylinder 37 .which encloses a piston 38. The piston 38 is moved under hydraulic pressure in a double acting construction. This enables positive insertion and retraction of the lance. The hydraulic system thus utilizes air from a suitable air pressure source delivered through a control valve 39 which connects to an air pressure regulator 40. The air pressure is regulated and provided to an air motor 41. The motor in turn is driven by the air to operate a hydraulic pump 42. There is an inlet line 43 connected to hydraulic oil sump 44. Hydraulic oil is delivered to a control valve 45. The valve controls the movement of the lance. Specifically, the lance is extended when the valve is in the illustrated position. The lance is retracted when the valve moves to the opposite position. The return line 46 returns the low pressure oil to the sump. The valve is connected so that power is applied for extension of .the lance and for retraction of the lance on operation of the valve. There is also additional equipment for positioning of the cylinder 37 as will be detailed in other views. As shown in the sectional view of FIG. 1, the lance has an elongate rod portion which terminates at a tip 48. The lance tip is sized to nest in the end of a tube 50. A seal is made when the tube and tip make contact. The seal enables fluid to be introduced into the tube 50. This is provided under pressure from the system shown in FIG. 1. In addition to the liquid which is delivered, there is an air inlet line 51 which connects with the lanced tip 48 to introduce air along with the liquid.

Figure 2:
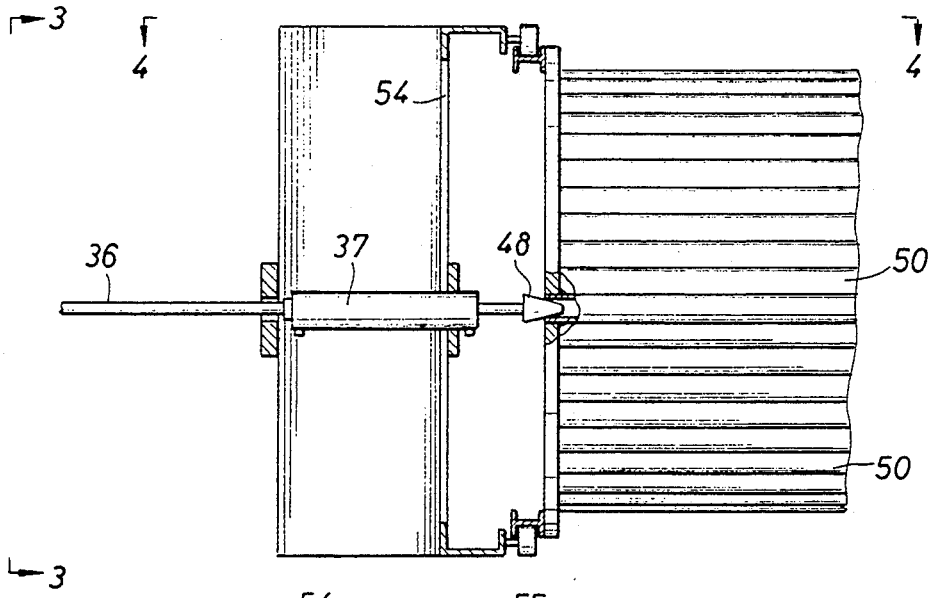
FIG. 2 is a side view of a lance mounting mechanism showing a lance which extends to seat against a tube to enable tube cleaning.
Figure 3:
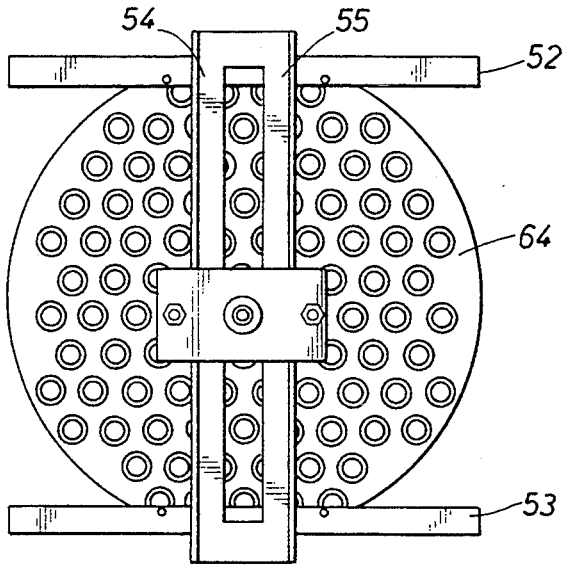
FIG. 3 is a sectional view along the line 3—3 of FIG. 2 and shows details of construction of the mechanism which aligns the lance with a particular tube for cleaning.
Figure 4:
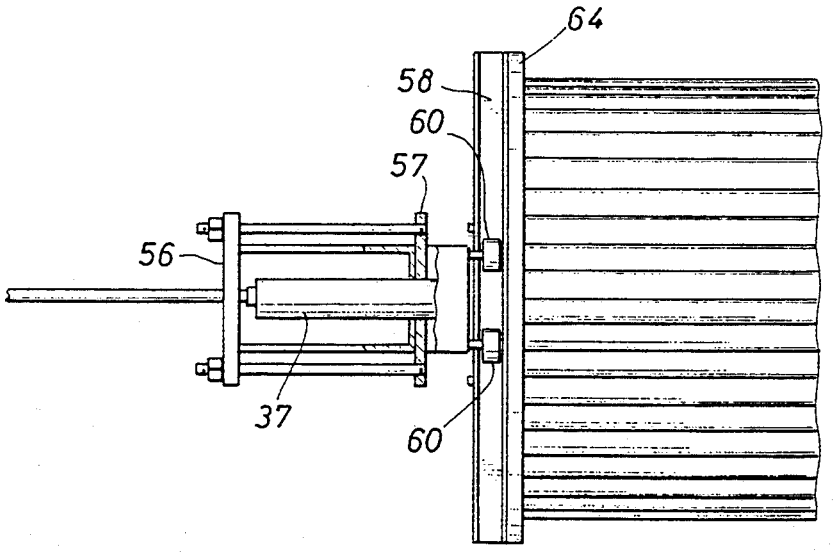
FIG. 4 is a sectional view along the line 4—4 of FIG. 2 showing details of construction of the lance insertion mechanism.

The lance 50 is moved with respect to a set of tubes in a fashion shown in FIGS. 2, 3 and 4. Very briefly, FIG. 2 shows the lance 36 which is supported and aligned by cylinder 37. It is mounted so that it travels on a pair of parallel rails 52 and 53 shown in FIG. 3 of the drawings. These permit movement in the X direction. The rails are parallel steel beams supported on rollers. A bracket is comprised of left and right frame members 54 and 55. They move as a unit. They enable vertical movement of the cylinder 37. More specifically, the frame members 54 and 55 define a gap where the lance extends through the gap. The cylinder 37 is anchored to the spaced plates 56 and 57 which capture the cylinder. The cylinder extends into a pair of guide surfaces and is supported against these guide services for controlled movement. The guide surfaces are formed along the edges of the frame members 54 and 55 and thus define the channel 58 shown in FIG. 4 of the drawings. Rollers at 60 are located in this channel. There are typically four rollers, two at each corner as shown in FIG. 4, and a corresponding duplicate pair on the opposite side.

The several rollers guide the cylinder 37 for movement as illustrated. When it moves up or down, it is guided by the rollers 60 which clamp on the outside of the parallel frame members 54 and 55. As previously mentioned, the frame members are able to move as a unit to the left or right as viewed in FIG. 3. While this provides one dimension of movement, the movement in the vertical direction in FIG. 3 is the second dimension of movement. When the cylinder 37 is extended, the lance is moved in the Z direction toward the tubes 50.

Attention is now directed to FIG. 2 of the drawings where it shows the nozzle 48 at a particular tube 50. The tube 50 is one of many. In fact, hundreds of tubes can be constructed in the heat exchanger. The heat exchanger is defined by a head 64 better shown in FIG. 3 of the drawings. The extendible lance is forced against one of the tubes. The heat exchanger tube 50 is temporarily plugged by a plug 66 shown in FIG. 1 of the drawings to perform the method of the present disclosure. In the practice of this method, the first step is to temporarily plug the tube 50 with the plug. The plug can leak somewhat. It is not important that it maintain a perfect seal; in fact, it is desirable that it provides some leakage so that the plug restricts flow but does not totally block fluid flow. The plug serves as a liquid flow barrier. Preferably it has a length equal to the diameter of the tube plus a friction of an inch greater length. This is the optimum length. If it were longer, it would work equally well, but it would also cause more frictional drag while the plug moves along the tube 50. In cleaning the tubes, the plug 66 is first placed in a tube and the lance is moved in an X and Y coordinate system until it is aligned with that particular tube. Then, the lance is extended and loosely seats against the tube that has been plugged. The first step is to fill the tube with water. This is accomplished by operation of the valves in the control panel. Going now to FIG. 1 of the drawings, this requires timed operation of the valves 25, 27 and 29. Briefly, these valves are provided with water through the adjustable orifice 18. The water is brought to pressure by raising the speed of the motor and the pressure of the pump 11. The first step is to open the valve 29. This requires opening the valve 27 as illustrated, and that valve will assumed to be left open at all points in time. As illustrated, it provides an alternate output which will be discussed later. In particular, however, the initial step involves opening the valve 29 to deliver water from the pump. This requires locking the valve 27 in the open position. It also involves opening the valve 25 to deliver fluid from the pump. The valves 25 and 29 are operated in this fashion to accumulate a column of water in the tube 50. Then, the valves 25 and 29 are temporarily reversed. This diverts water flow back to the sump. This also permits pressure to build up in the water system. The pressure buildup is achieved upstream of the restrictive orifice 18. Then after an interval, the valves 25 and 29 are simultaneously switched. This delivers a pressure surge through the distribution line into the lance. At that point, there is a standing column of water extending from the pump 11 through the valve 16 and to the orifice 18. In addition, there is a bubble free column of water extending from the orifice 18 through the series of valves and to the lance. When switching occurs, the surge of pressure which is experienced downstream of the switched valves provides a surge of pressure into the fouled tube 50. This has the form of a fluid shock which is administered through the solid column of water. When that occurs, there is a tube impact which jars the coating materials on the inside of the tube.

When this shock loading is formed in the tube, the plug 66 may leak or may be forced downstream. No particular problem arises from that because water is always being added through the pump output. The incorporation of the orifice 18 coupled with the standing column of water downstream assures that the system transmits into the dirty tube the cleaning shock wave. The shock wave has the form of a change in pressure propagated through the standing column of water. This forms a shock wave which is experienced in the tube but it is not a pressure wave which is built up behind the plug 66. In fact, it is not normal to use a plug to hold against high pump pressure. So to speak, the plug is only a sufficient retardant to prevent complete escape of the water. The plug 66 will chatter and skid, moving finally to the far end of the tube 50. In other words, it merely helps accumulate low pressure, static water in the tube. The system utilizes a positive displacement pump which enables the system to provide a relatively constant fluid output. As the pressure buildup is formed and is switched by the valve operation as mentioned, the water in the tube serves the useful purpose of breaking up the coating of material on the inside of the tube.

As one basis for explanation, it is thought that the water flow establishes something of a resonant frequency in the standing column of water that is in the tube 50. Speaking very loosely, this has the approximate form of an organ pipe which provides a resonant tone dependent upon the pipe length. Here, a resonant frequency is fortned, or at least harmonics of the resonant tone. It is operated at an elevated pressure. Therefore, it is conjectured that a resonant standing wave is formed in the tube. The wave length is quite short in comparison with an organ pipe where the tone may have a length of one-half or one quarter wave length. In this particular instance, there is a resonant frequency which can be established as a result of vibration created in the pipe. Partly, the vibration derives from the fluid flow into the pipe through the nozzle when the pressure surge is applied.

This process forms a resonant frequency vibration in the standing column of water. Even where the column of water is mixed with air and there are numerous air bubbles in the column of water, it still forms shock waves in the manner described. The introduction of air typically has the form of air bubbles which are scattered through the standing column of water in the tube. Bubbles will be scattered whether the tube is maintained in a horizontal or vertical position for cleaning. Typically, vibrations in the standing column followed by repetitive switching of the valves 25 and 29 assures that the standing wave in the tube 50 has a cleaning effect. The cleaning effect enhances, it is thought, by the presence of entrained gas bubbles. This enables the water to break up and form regions of extremely high pressure and regions of much lower pressure, and it is hypothetically believed that those regions produce low pressure vaporization. In effect, there is a partial void momentarily formed in the tube, and the void may well be a type of cavitation. Ordinarily, cavitation occurs with liquid flow so microscopic bubbles form and then collapse to fill the bubbles, i.e., it undergoes cavitation. As will be understood, the foregoing is described for purposes of advancing a theory for the mode of operation. It is conjectured that the introduction of pressure surges by operation of the equipment as described yields a pipe cleaning process in which the fouling material collecting on the wall is completely broken up. There will be some flow along the tube 50 from left to right as viewed in FIG. 1. In part, this results from the fact that the tube is not permanently plugged.

As a generalization, the pressure at the pump 11 is typically in excess of 10,000 psi. The pressure at the tip of the lance 48 is preferably also in that range. As will be understood, this is a representative pressure. The valves 25 and 29 are cycled periodically. They are cycled in a sequence which occurs periodically also. The typical rate of operation requires switching these valves as fast as every half second or as slow as every five seconds.

Going now to FIGS. 2, 3 and 4 considered jointly, assume for purposes of description that a first tube is cleaned. After it has been cleaned the equipment is operated to move to an adjacent tube selected with appropriate X and Y definition. As observed, the equipment in FIGS. 2, 3 and 4 moves smoothly on rollers. It can be moved to the: left or right as shown in FIG. 3 utilizing the X dimension and can be moved to vary the location of the lance vertically or movement in the Y direction. As shown in FIG. 4, the lance is advanced towards the bundle of tubes, that representing movement in the Z direction.

In operation, the procedure is initiated by first placing the small plug 66 in a tube. The lance is advanced until it is nested against the end of that tube see FIG. 2 of the drawings. At this point the plug is just slightly along the tube 50 from the same end as the lance tip. As mentioned, a column of water is formed in that short portion of the tube. The column is water is collected in that short portion of the tube at a low or static pressure. Then, the pump 11 is operated at a higher pressure by increasing the speed of motor 12. The switching routine previously mentioned involving the valves 25 and 29 is initiated. In this initial position, of the plug 66 may limit the length of the column of water substantially. Water however is delivered into the lance and flows in the tube 50 and moves the plug 66 to the right. Again, it should noted that movement of the plug 66 involves accumulation of a column of water but does not involve operation at a high pressure. The water jetting action into the column of water sets up the shock waves formed in the column of water. That is the cleaning mechanism. That flow also forces the plug 66 further to the right. Behind the plug, the column is cleaned to provide a smooth bore; by that, the tube 50 is cleaned and the accumulated materials on the interior are broken free. To the right of the plug 66, no cleaning has yet occurred. This means that the plug 66 must slide on a rough surface. This retards its rapid movement to the right. Again, its movement to the right occurs with cleaning action of the standing shock waves formed in the column of water. The plug will move with a stuttering or chattering motion. As it moves along the tube 50, it stops and starts in a fashion providing a continuous lengthening of the column of water undergoing shock wave treatment. When the plug 66 arrives at the far end of the tube 50, it typically falls out of the tube. Typically, it can be retrieved and inserted by hand into another tube 50 for subsequent cleaning of an additional tube. The cleaning sequence may require that particularly difficult tubes be cleaned two or three times. It is not uncommon to require repeated passes. This depends on the bonding that occurs between the accumulation of coating material in the tube and the metal wall defining the tube 50.

The foregoing process is carried out with an X and Y movement pattern to assure that all the tubes in the bundle are ultimately cleaned. The operator can operate the hydraulics to provide such a cleaning sequence as viewed from one end of the tube bundle, see FIG. 3. In each particular tube, the lance is extended to nest up against the end of the tube. As previously mentioned, there may be some leakage at the lance tip 48. It is not important that a perfect seal be obtained between the lance tip and the tube. Rather, it is important thane the water be accumulated as a standing column. If there is leakage around the lance tip, it is typically overcome by the rate of delivery of additional water. Leakage is not a problem unless it become excessive where the lance cannot properly seat against the end of the tube. It sometimes occurs that the tubes have been distorted and they are no longer circular. In that instance, the lance tip 48 can be seated more readily by placing a paper towel or other wrap around the lance tip to provide a padding. Again, it is not important that modest amounts of leakage occur. What is important is that a standing column of water be established from the tip of the lance into the tube 50 undergoing cleaning and that the entire column of water be agitated by means of shock waves as previously mentioned.

While the foregoing is directed to the preferred embodiment, the scope is determined by the claims which follow:

What is claimed is:

1. A method of cleaning a tube comprising the steps of:

(a) introducing a liquid to the inner surfaces of a tube to be cleaned;

(b) forming a column of liquid defined by a valve at one end of the column and a plug inserted into said tube on the other end of the column wherein the said column of liquid in introduced by a pump operatedd by a motor and wherein said pump is connected to an orifice;

(c) restricting flow volume so a high flow volume downstream of the orifice is accompanied by a low downstream pressure while a low flow volume downstream is accompanied by a high downstream pressure;

(d) introducing a controlled pressure surge to the column of liquid through said valve;

(e) cycling the pressure in the tube between high pressure and low pressure;

(f) thus creating a shock wave along the length of the tube to the plug wherein said shock wave is enhanced by mixing the liquid with injected air.

2. The method as claimed in claim 1 wherein the column of liquid is under pressure from said pump at one end of the column and the plug inserted into the tube at the other end, wherein the plug is moved from the proximal opening of the tube to the distal opening of the tube under the pressure surge cycles.

3. The method as claimed in claim 2 wherein said tube is cleaned in progressive lengths as the plug moves under pressure along the length of the tube.

4. The method as claimed in claim 3 wherein said plug has an external surface to frictionally grip the tube,

5. The method as claimed in claim 4 wherein said tube is cleaned in progressive lengths as the plug moves under pressure along the length of the tube frictionally engaging the wall of the uncleaned tube.

6. The method as claimed in claim 5 wherein the said pressure in the tube is at least 10,000 psi.

7. The method of claim 6 wherein a low flow volume of liquid is required to move the plug along the tube.

8. A method of cleaning the interior of a tube comprising the steps of:

(a) delivering a liquid into a tube to be cleaned from a sump by a pump operated by a motor;

(b) introducing the liquid by a valve switched to a first position to deliver the liquid through an orifice, or the valve is switched to a second position to the sump;

(c) directing the liquid through an output line to a lance mounted on and moved by a piston and cylinder mechanism enabling control of lance insertion and retraction into the tube to be cleaned wherein said lance is profiled so that it forms a rapid, releasable seal in the end of the tube;

(d) moving the lance in an X and Y defined coordinate system to align the lance with a selected tube;

(e) moving the lance in the Z direction to engage and seal the tube to be cleaned;

(f) on lance engagement, placing the tip of the lance in the tube to be cleaned;

(g) forming a pressure surge by switched operation of the pump delivering said liquid through said orifice;

(h) defining a column of liquid from the pump on one end to a plug in the tube;

(i) wherein pressure surges on the column of liquid exerts cleaning forces within said tube;

(j) cycling tube pressure cooperatively using the pump, orifice and valve to form shock waves in the liquid column where the shock waves travel in the tube to clean the tube; wherein said pressure surges are enhanced by mixing the liquid with injected air.

9. The method as claimed in claim 8 wherein said tube is cleaned in progressive lengths as the plug moves under liquid pressure along the length of the tube.

10. The method as claimed in claim 9 wherein said tube is cleaned in progressive lengths as the plug moves under pressure along the length of the tube frictionally engaging the wall of the uncleaned tube.

11. The method as claimed in claim 10 wherein pressure in the tube is at least 10,000 psi.

12. The method as claimed in claim 11 wherein a base or acid is added to the liquid and the liquid is primarily water.

13. The method of claim 8 wherein said lance introduces air into said liquid.

14. The method of claim 8 wherein said cycling of said valve is performed by switching said valves periodically at a rate from ½ second to 5 seconds.

* * * * *